United States Patent [19]

Huang et al.

[11] 4,060,242

[45] Nov. 29, 1977

[54] ELECTRONIC GAME APPARATUS

[76] Inventors: Thomas L. Huang; Ling Ling Huang, both of 5565-02 Walnut Blossom Drive, San Jose, Calif. 95123

[21] Appl. No.: 606,439

[22] Filed: Aug. 21, 1975

[51] Int. Cl.[2] ..... A63B 71/06

[52] U.S. Cl. ..... 273/1 E; 273/130 AB; 273/138 A

[58] Field of Search ..... 35/22 R, 29 R, 6; 273/1 E, 85 R, 130 AB, 136 A, 138 A, 139, 141 A, 143 R, 142 R

[56] References Cited

U.S. PATENT DOCUMENTS

| | | | |
|---|---|---|---|
| 3,284,083 | 11/1966 | Levin et al. | 273/138 A |
| 3,747,936 | 7/1973 | Ohki | 273/143 R |
| 3,759,525 | 9/1973 | Davis | 273/143 R |
| 3,770,269 | 11/1973 | Elder | 273/1 E |
| 3,808,705 | 5/1974 | Schmoyer | 35/9 A X |
| 3,819,186 | 6/1974 | Hinterstocker | 273/138 A |
| 3,834,710 | 9/1974 | Sousan | 273/138 A |

OTHER PUBLICATIONS

Radio Electronics; "Electronic Casino;" Part I; Mar. 1974; pp. 45, 50–52, 86.

Radio Electronics; "Electronic Casino;" Part II; Apr. 1974; pp. 58, 59.

*Primary Examiner*—Richard C. Pinkham
*Assistant Examiner*—Vance Y. Hum
*Attorney, Agent, or Firm*—Joseph L. Spiegel

[57] ABSTRACT

Electronic game apparatus includes a series of lights that are rapidly and repetitively illuminated in succession to simulate a rapidly moving light. A player has under his control a switch which, when actuated, stops the apparent movement on a particular light. Different packaging schemes provide a variety of ways in which the game can be played either by one or more players. A variable frequency oscillator allows the speed at which the series is illuminated to be varied or adjusted to suit a player's skill and interest and to allow the game to be played as a game of skill or of chance. Alternate embodiments allow either one light at a time to be lit or the series can be completely turned on one at a time. Additionally, the direction in which the lights are illuminated can be either unidirectional or bidirectional. The game apparatus may also include automatic score keeping facilities.

6 Claims, 11 Drawing Figures

ELECTRONIC GAME APPARATUS

BACKGROUND OF THE INVENTION

1. Field of the Invention

This invention relates to electronic game apparatus and, in particular, to a game in which a series of lights or light emitting devices are rapidly illuminated in succession and a player attempts to stop the succession on a desired one of the lights.

2. Prior Art

Various forms of electrical games are known in the prior art in which a player or players interact through some form of a switch with a visual or light display; however, to our knowledge, none of these prior art games is played with the same objectives, nor is any constructed and operated in the same manner as our invention. U.S. Pat. No. 2,458,892-Burdick discloses a game in which three rows of lights simulate dropping a bomb on a ship. The object of the game is for the player to control the lighting so that three horizontally positioned lights at a time appear to drop a bomb on the ship. U.S. Pat. No. 3,770,269-Elder discloses a game in which a group of lights is randomly illuminated and the player attempts to stop the process so that one light is on corresponding to a symbol preselected by the player. U.S. Pat. No. 3,637,212-Hurley discloses a bird shoot game having a series of lights simulating the flight path of a bird. The player controls a "hunter" so as to "shoot" at the bird. If a hit occurs, a series of lights simulating a falling bird are illuminated. The player tries to time the point at which shooting occurs so the bullet trajectory intercepts the path flight.

SUMMARY OF THE INVENTION

An object of the invention is to provide a game apparatus in which a series of lights are rapidly illuminated in orderly succession repetitively and the player attempts to stop the successive lighting on a desired light.

Another object of the invention is to provide a game that simulates a lighting streak through a series of lights associated with different scores, wherein the player attempts to stop the streak on a light with a high score or credit.

Still another object is to provide a game in which a player interacts with a series of lights that are rapidly illuminated in succession repetitively and wherein the player can vary the speed at which the lights are sequentially lit to suit the player's skill or desires.

Another object is to provide at least one additional series of lights or a display that automatically keeps score and indicates the progression of the game.

A further object is to provide a game constructed from conventional small electronic devices that can readily be packaged into a unit of a size adapted to be held in the hand of a player or placed on a suitable support surface.

Other objects and advantages of the invention will be apparent from the following description taken in connection with the accompanying drawing wherein.

DETAILED DESCRIPTION

Figure 1:
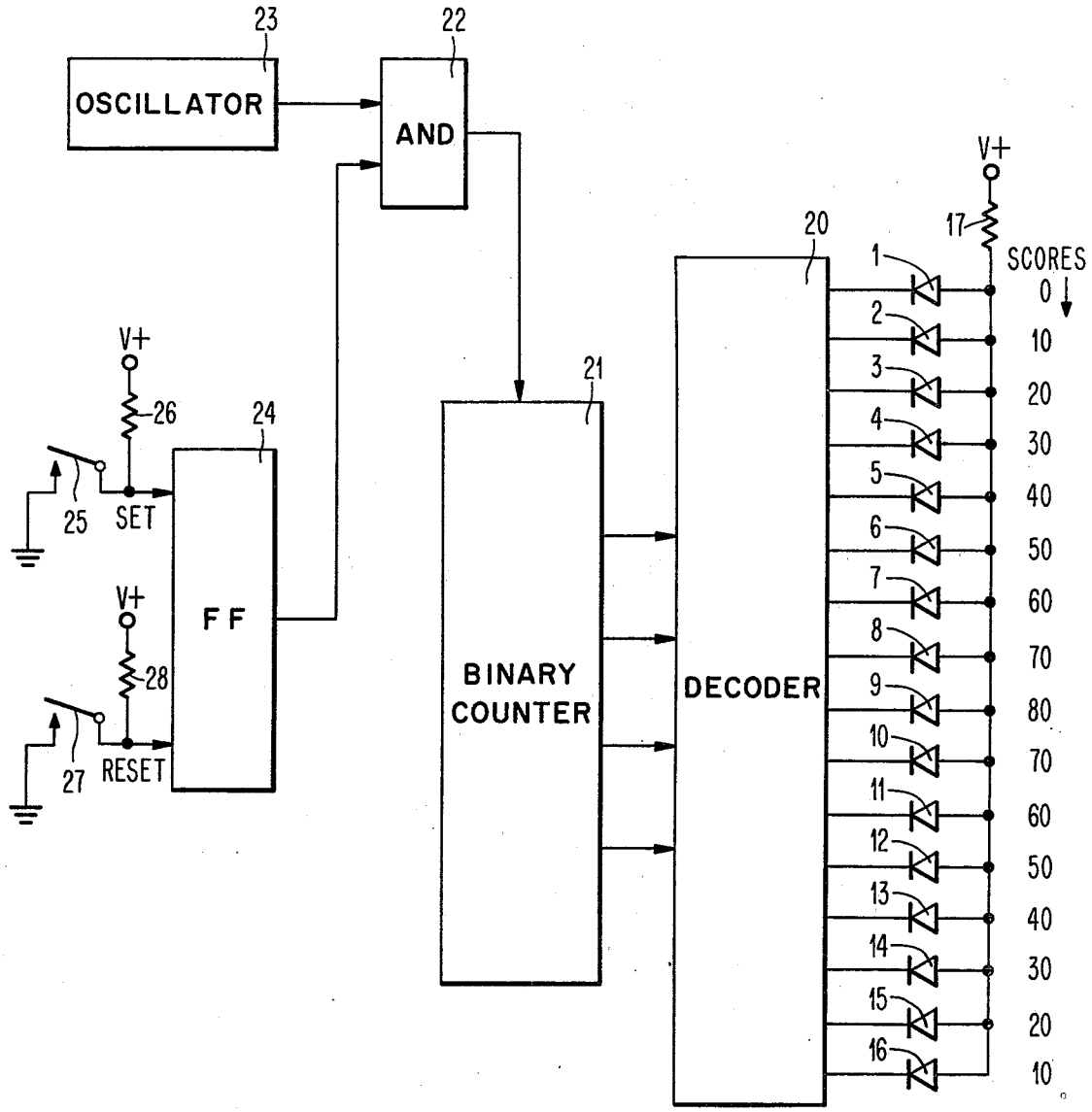
FIG. 1 is a schematic block diagram of one embodiment of the invention.

Referring now to the drawing and first to FIG. 1, the embodiment of the invention there shown includes a series of lights in the form of light emitting diodes (LED) 1–16. These elements may be arranged linearly or curvilinearly in the view of a player to provide a fixed predetermined path. Lights 1–16 are connected to a voltage source V+ through a current limiting resistor 17 connected in common to all the anodes of the LED's. The cathodes are connected to the output lines of a four-to-sixteen bit decorder 20 so that when an output line is active, the associated LED conducts and emits light. Each of the lights may be associated with a score that is arbitrarily assigned to provide interest to the player. The scores may be progressively higher or lower, random or any combination. As shown, the scores run from zero to eighty and back to ten by tens.

The input to decoder 20 is connected to the output of a four bit binary counter 21 having a wrap-around type output. The bit pattern appearing at the output of counter 21 determines which of the lights will be lit at any given time. The operation of counter 21 is controlled by an AND (A) circuit 22 having two inputs, respectively connected to a variable frequency oscillator 23 and a flip-flop (FF) 24. The oscillator provides a continuous series of pulses to A 22 and the output from FF 24 is used to control whether these pulses will be passed on to the counter. Switches 25 and 27 are connected to the SET and RESET inputs of FF 24, these switches being also connected between potential source V+ and ground through resistors 26 and 28, respectively.

In the preferred form of the game, the potential source is a battery and a power switch (FIG. 7) provides on-off control for the game. At the start, the player would turn the power switch on to activate the circuits shown in FIG. 1. To play the game, the player closes switch 25 and such action provides a signal that sets FF 24. When thus set, the output of FF 24 activates A 22 whereupon the output from oscillator 23 causes A 22 to transmit a similar chain of pulses to counter 21. Each successive active pulse thus applied to the input of counter 21 causes the four-bit output thereof to change. Consequently, counter 21 causes successive output lines from decoder 20 to illuminate or activate corresponding ones of LED 1–16. In the embodiment of FIG. 1, the lights are lit in succession from LED 1 to LED 16 and then repeated beginning with LED 1.

With the game functioning as described above, the player can then attempt to stop the successive lighting on a desired light such as the one associated with the highest score. To do this, the player closes switch 27 to reset FF 24. In turn, this deactivates A 22 so that the output of counter 21 stops changing. Therefore, the light associated with the particular output of counter 21 will remain lit. The player can record his score if so desired and then proceed with further play by closing switch 25. The effect presented to the player by this embodiment is one of a moving light where the player tries to catch the light or stop the light at a desired position, such as one corresponding with a desired score.

Figure 2:
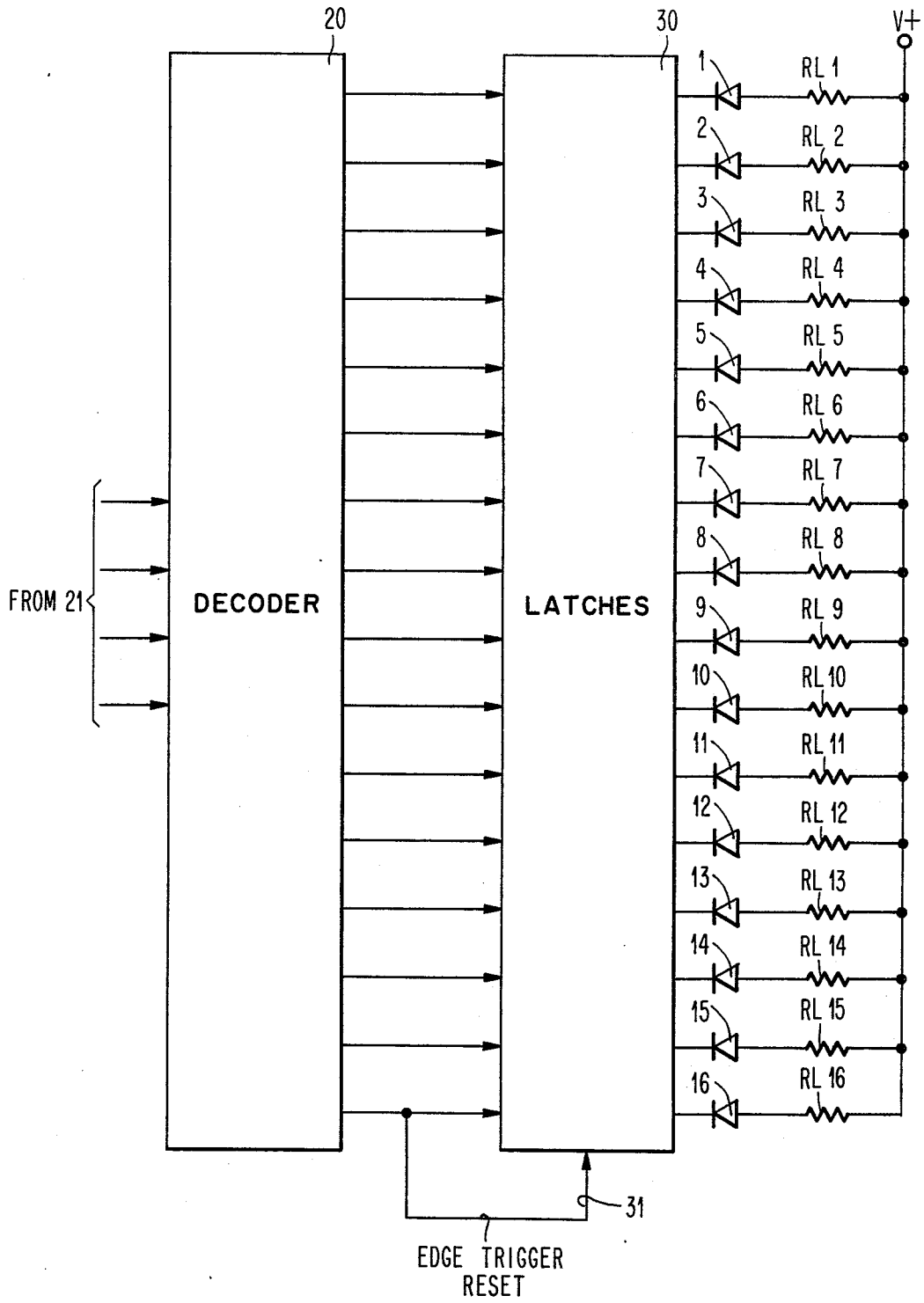
FIGS. 2 and 3 are schematic block diagrams of two modifications of the embodiment shown in FIG. 1.

With reference to FIG. 2, the embodiment described above can be modified to provide a different effect. A series of latches 30 corresponding in number to the number of output lines from decoder 20 and to LED 1–16, are connected therebetween. Also, individual current limiting resistors RL1–RL16 are connected to the lights. The outputs of the latches are one-by-one set to a down level by the decoder outputs. As a result, once a light is turned on, it remains on until the latch outputs are reset to their up level. This is done by using the trailing edge of the lower output from decoder 20 to reset latches 30, this signal being applied to the reset inputs via line 31. The effect is to present to the player a lighting streak that grows in length and wherein the object is to stop the growth at a desired length or score.

Figure 3:
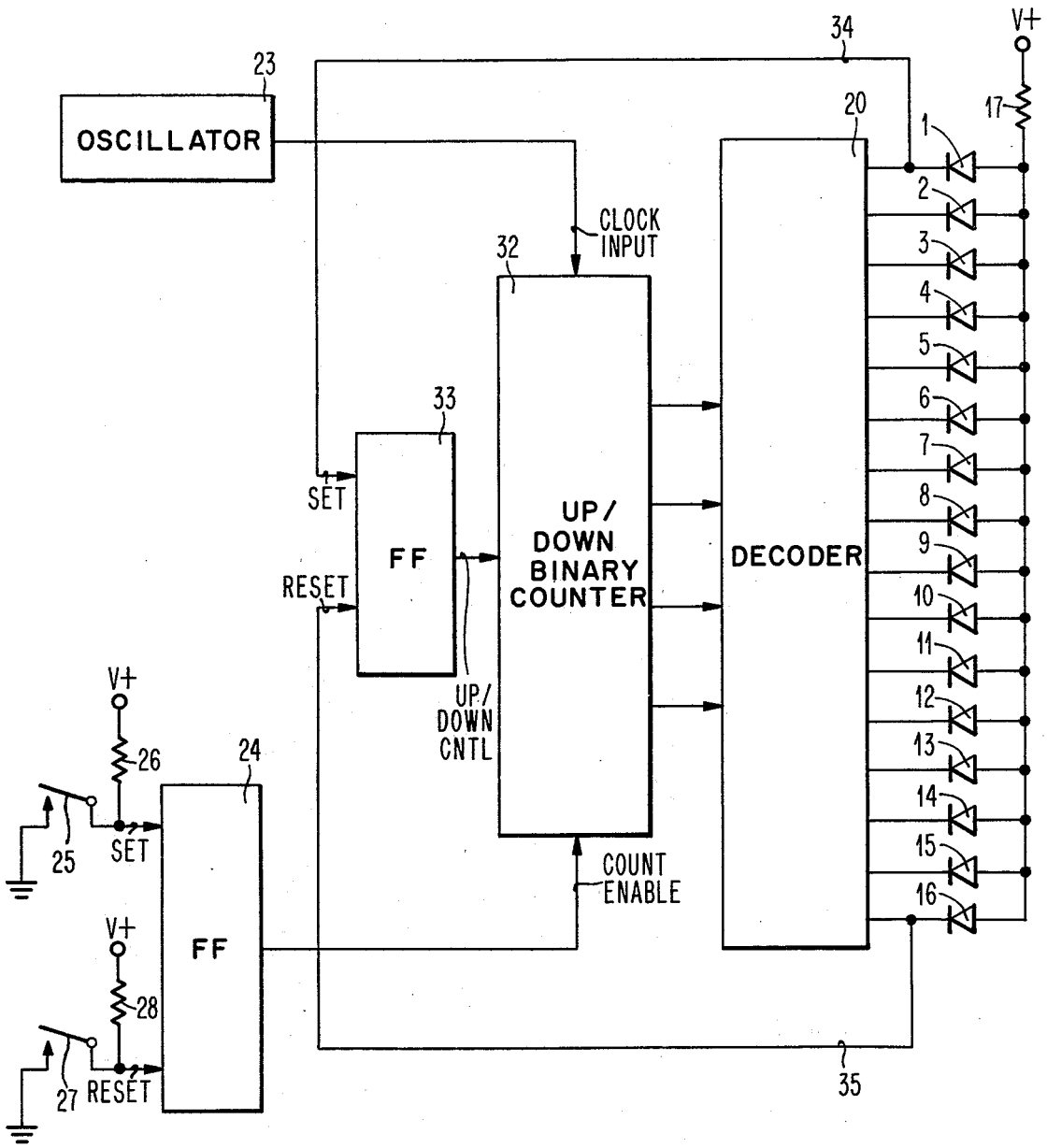

A further variation in the basic game is achieved with the embodiment shown in FIG. 3 wherein elements the same as those previously described have identical reference numerals. In this embodiment, the lighting streak is caused to move back and forth, i.e., bi-directionally, between the end lights. To accomplish this, a four bit binary counter 32 is provided, the counter being of the type having up/down control instead of the wrap-around type. Counter 32 has three inputs, one being connected to oscillator 23 to receive pulses therefrom for stepping the counter. Another input is connected to the output of a flip flop (FF) 33 to provide up/down control. When the output level is up, due to FF 33 being set, counter 32 counts up and when the level is down due to FF 33 being reset, the counter counts down. The SET and RESET inputs of FF 33 are connected by lines 34 and 35 to LED 1 and LED 16 respectively so that when these devices are activated, appropriate signals are applied to operate FF 33. The third input to counter 32 is connected to the output of FF 24 for the purpose of providing a signal controlled by FF 24 that enables and disables counter 32. When FF 24 is set upon the closing of switch 25, counter 32 is enabled allowing it to count under the control of oscillator 23 and FF 33, and when FF 24 is reset, counter 32 is disabled from further counting whereby the then existing signals on the output thereof control which light is lit.

In the operation of the embodiment of FIG. 3, the player closes switch 25 to initiate the lighting streak. The streak travels back and forth until the player closes switch 27 whereupon one light will remain lit which light corresponds to the count stored in counter 32. Such light may then be used as the player's score.

As previously indicated, oscillator 23 is variable and may be adjusted by the player to a speed that matches the player's skills or desires. The rate may vary from 0.001 seconds to one second to provide a range of time or operation suitable for different players. When the frequency of the oscillator is slow, the skill of the operator determines where the lighting streak stops, and the apparatus provides a game of skill. When the frequency of the oscillator is fast or rapid, the point at which the lighting streak can be stopped is no longer controllable by the player, and it becomes a game of chance.

Figure 7:
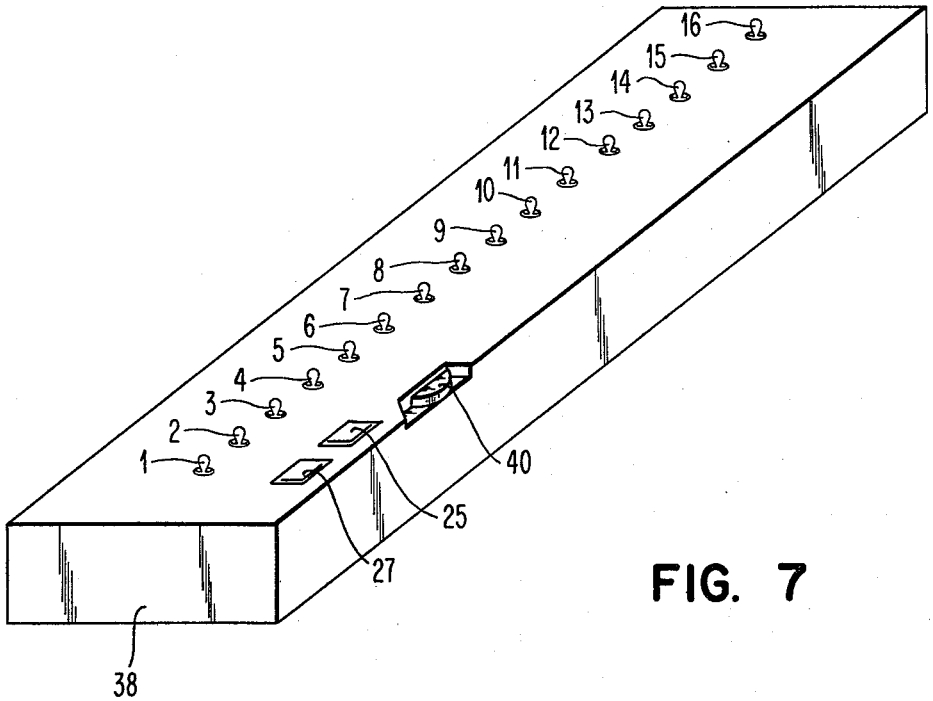
FIGS. 7–11 are perspective views of different ways in which the various embodiments may be packaged.
Figure 8:
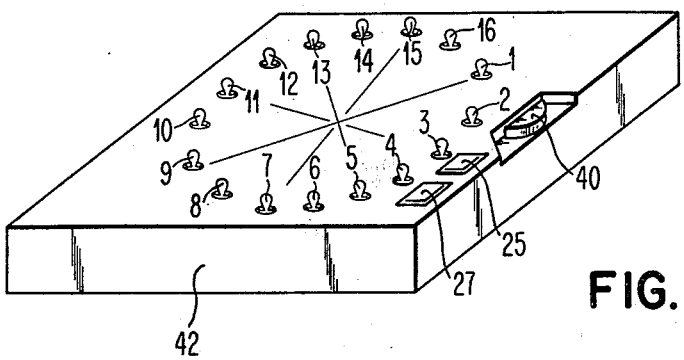

The embodiments described thus far can readily be packaged as shown in FIGS. 7 and 8, wherein LED's 1–16 are arranged along a line and in a circle on housings 38 and 42, respectively. Switches 25 and 27 are located along one edge of the housing to facilitate operation thereof and a rotary on/off switch 40 is located nearby. Switch 40 is connected to control operation of a battery located within the housing and providing the power for operation of the game. Switch 40 is also connected to a variable impedance element that controls the rate or frequency at which oscillator 23 operates. In these embodiments, the light streaks along the line from one end to the other in the one embodiment of FIG. 7 and it streaks continously around the circle in the embodiment of FIG. 8.

The above embodiments are playable in a variety of ways with either a single player or more than one player. In some instances, scores or records of the progression of play can be kept manually such as by using pencil and paper. In the embodiments of FIGS. 4–6 and 9–11, the game includes automatic score keeping facilities. In each of these embodiments, eight LED's 1–8 are connected to the output of a three-to-eight decoder 48 that controls the activation of the LED's. The input to decorder 48 is connected to the output of a three bit binary counter 46 that is controlled by oscillator 23 and FF 24.

Figure 9:
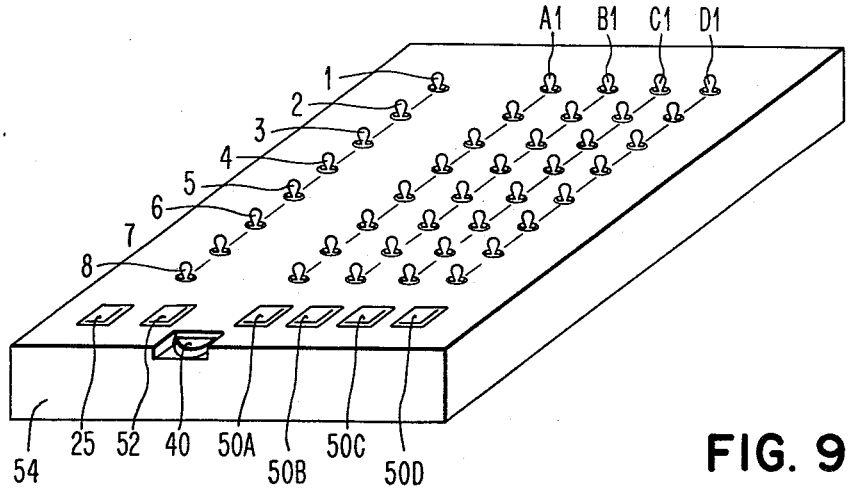

Referring to FIG. 9, the embodiment there shown includes a housing 54 having a column of LED's 1–8 arranged along one edge. Four additional columns of LED's A–D 1–8 are mounted on the housing for the purpose of keeping score. Four momentary contact switches 50A–D are mounted at the bottom of the housing. This embodiment is designed for use by up to four players each of whom would use one of switches 50 to stop the lighting streak along the first column and attempt to light all the lights in a scoring column associated with the player.

Figure 4:
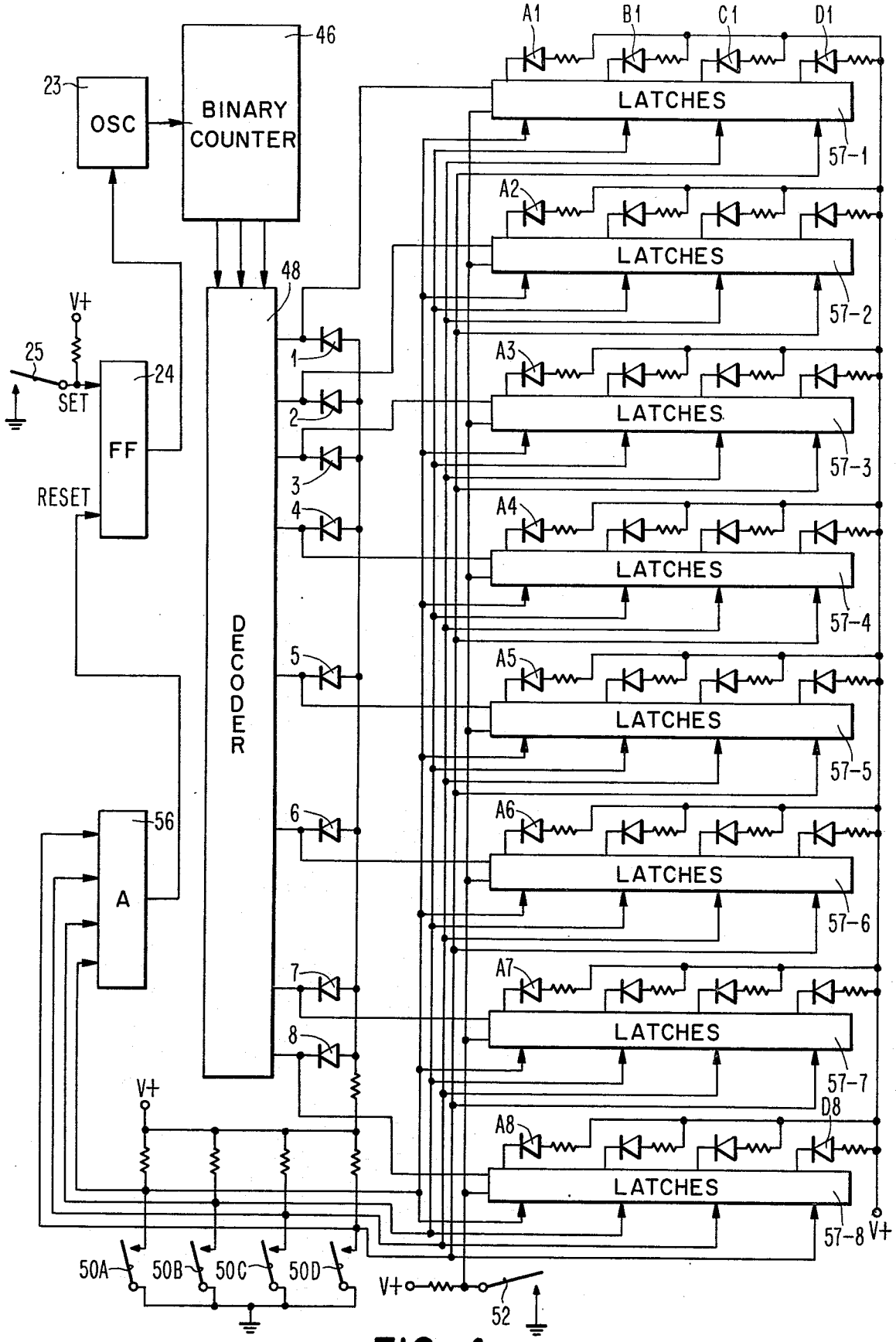
FIGS. 4, 5 and 6 are schematic block diagrams of different embodiments of the invention.

Referring now to FIG. 4, switches 50 are connected through an AND circuit 56 to the reset input of FF 24. Switch 25 is used as before to initiate the lighting streak by setting FF 24. When a player then activates his associated switch, FF 24 is reset to stop the streak on the light corresponding to the output of decoder 48. The scoring lights are connected to rows of latches 57–1 through 57–8 wherein each row is connected to a corresponding one of LED's 1–8. Each row of latches 57 contains four latches connected to respective ones of a row of the scoring lights so that when a latch is set, the corresponding LED is lit. Switches 50 A–D are also connected respectively to all of the latches in an associated column so that when one of these switches is actuated, an input signal is applied to all of the latches in the associated column. When one of LED's 1–8 is lit, the active signal is applied to all of the latches 57 in the connected row whereby the presence of an active signal from such light and a signal due to the closing of one of switches 50 sets the corresponding latch and activates the associated scoring light. A switch 52 is connected to the reset inputs of all of latches 57 allowing the scoring lights to be turned off at the end of a game.

Figure 10:
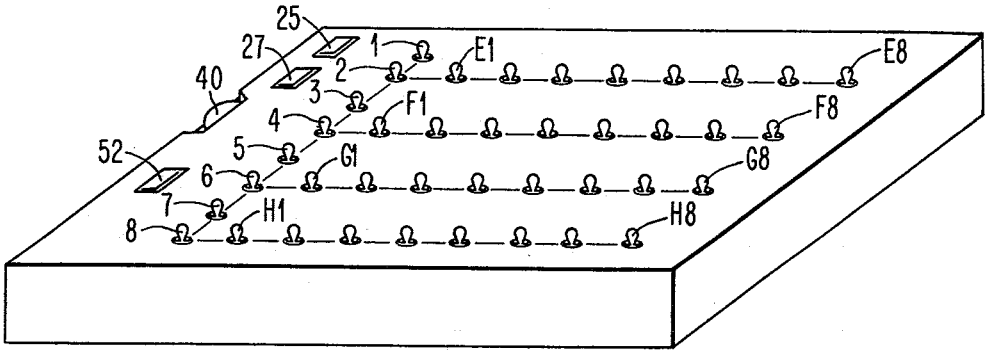

In the embodiment of FIG. 10, LED's 1–8 are arranged in a column along one edge and four rows of scoring lights E–H 1–8 extend to the right of LED's 2, 4, 6 and 8. In this embodiment, each row of scoring lights is assigned to or associated with a different player. Each player is in turn given control of the game and attempts to stop the streak on the light associated with the assigned scoring row, and each time a player succeeds in doing so, the next LED in the scoring row is lit. If a player should stop the streak on a light associated with another player's scoring row, then the other player is benefitted.

Figure 5:
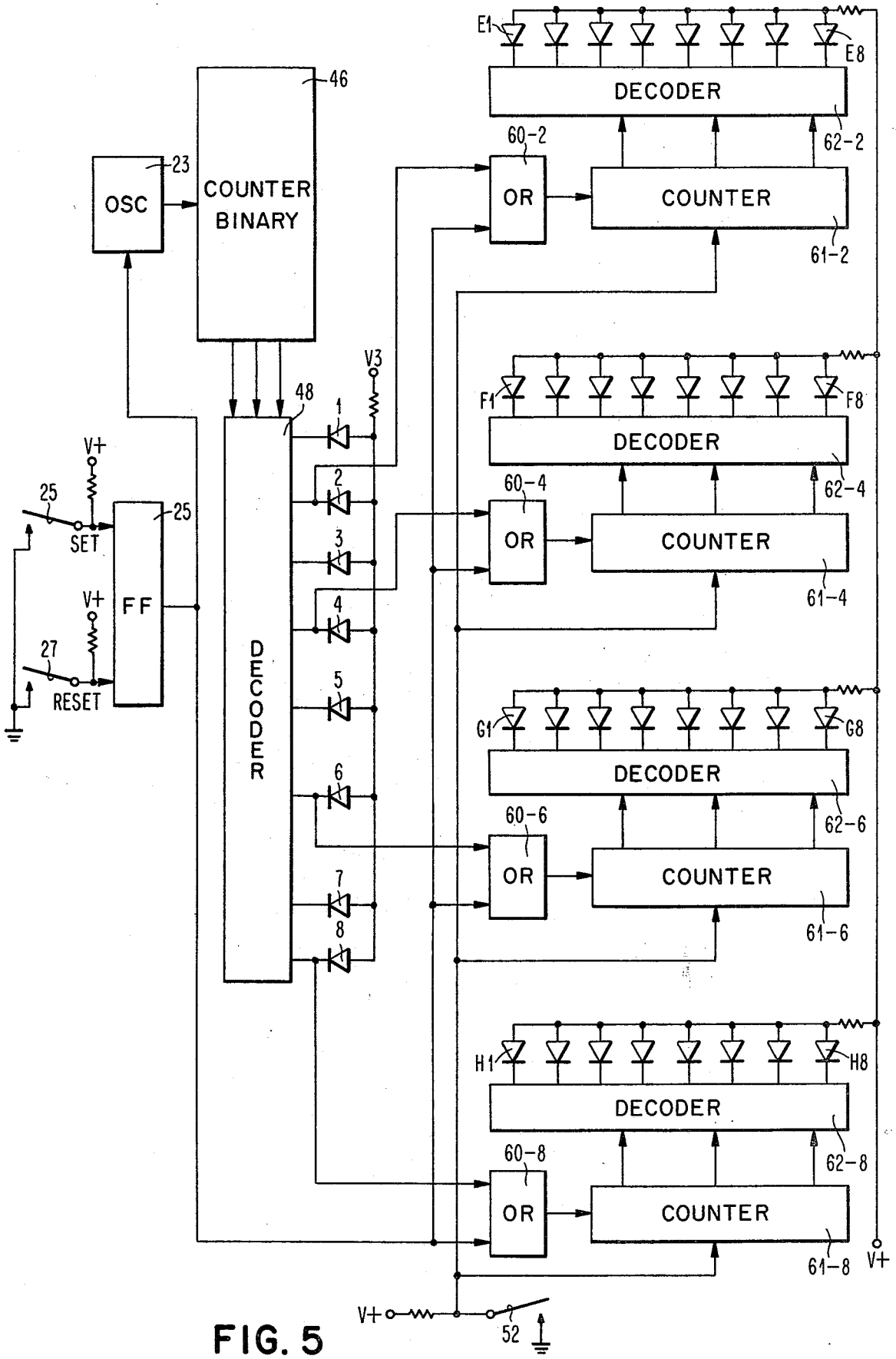

The preceding mode of operation and play is achieved with the circuit shown in FIG. 5. Switches 25 and 27 are used to initiate and stop the streak in the manner previously described. The output of FF 24 is also connected to one input of each of four OR gates 60–2, 60–4, 60–6 and 60–8 which have their other inputs connected to LED's 2, 4, 6 and 8 respectively. The coincidence of FF 24 being reset and one of LED's 2, 4, 6 or 8 being lit causes the associated OR gate 60 to apply a stepping pulse to a three bit counter 61 connected to a three-to-eight bit decoder 62. The decoders 62 are each connected to a row of the scoring lights. In operation, when a switch 52 is closed, a clear signal is applied to each of counters 61 to reset the decoders 62 whereby the first scoring lights E1, F1, G1 and H1 are lit. Closing switch 25 starts the streak and the streak is stopped by closing switch 27. Should the streak stop with one of LED's 2, 4, 6 or 8 lit, the counter associated with such light is stepped by one causing the next scoring light to be lit. The winner is the first player associated with the row in which the last scoring light is lit.

Figure 11:
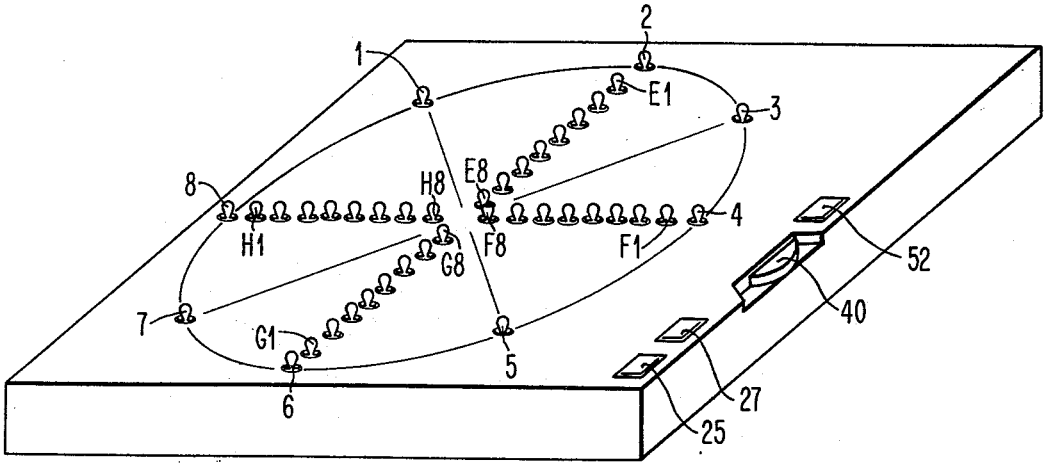

FIG. 11 shows another way in which the lights of the embodiments of FIG. 5 can be arranged. Here, the LED's 1–8 are arranged in a circle and the scoring light E–G 1–8 are arranged in lines radially aligned with LED's 2, 4, 6 and 8.

Figure 6:
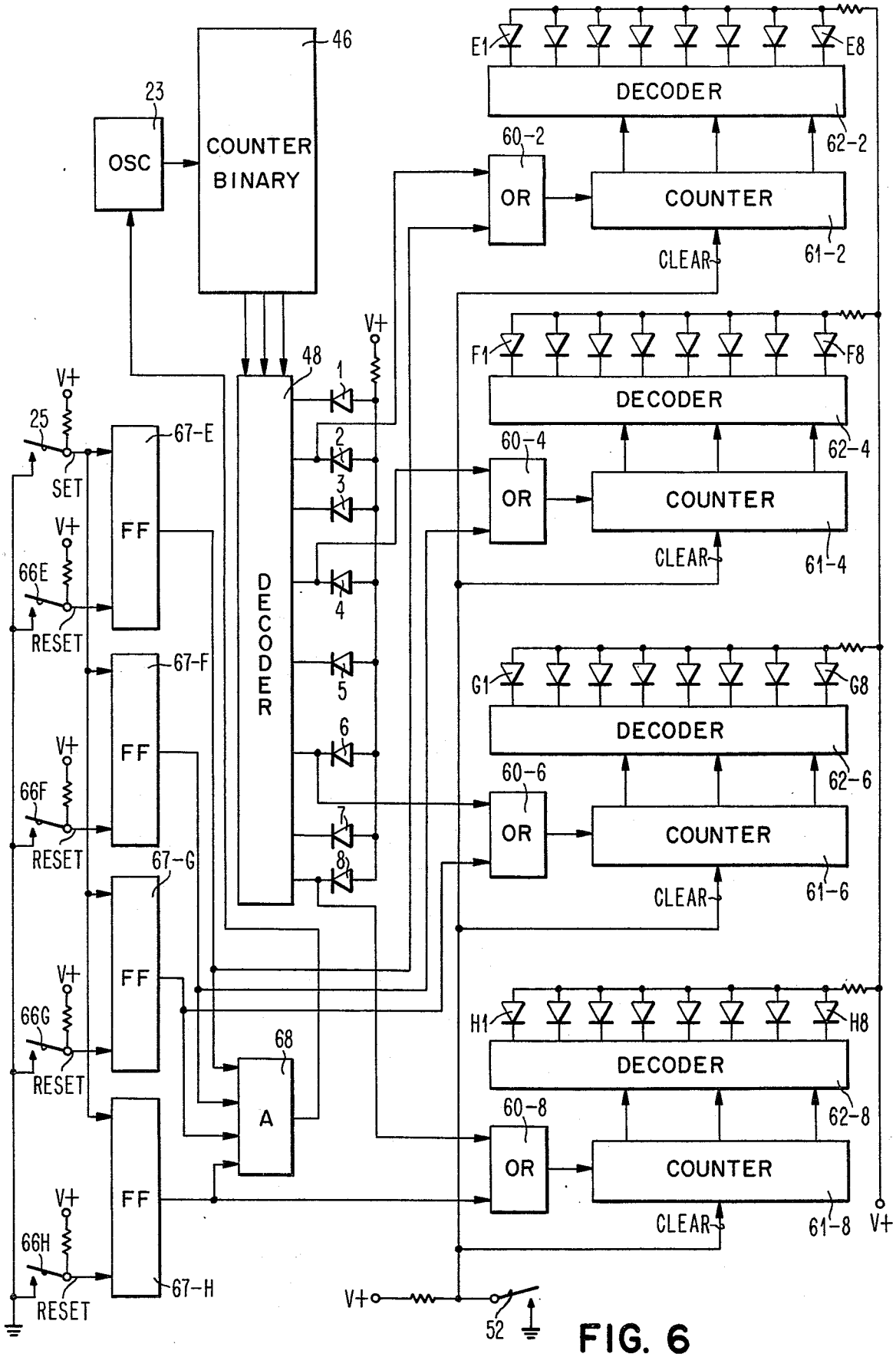

In the embodiment just described, should one player stop the streak at a light corresponding to another player's scoring row, the other player gets the score. To prevent this, the game can be arranged as shown in FIG. 6, wherein each player is assigned to operate a different one of switches 66 E–H. Four FF 67 E–H have their reset inputs connected to switches 66 E–H respectively so that closing of any switch will reset its associated FF. Switch 25 is connected to all of the set inputs of FF 67. The outputs of FF 67 are connected to the input of an AND circuit 68 whose output is connected to oscillator 23. A reset state at the output of any one of FF 67 results in a down level output from the AND circuit 68 which in turn deactivates the oscillator. The outputs of FF 67 E–H are also connected to one input of OR circuits 60–2, 60–4, 60–6 and 60–8, respectively.

Switch 25 is closed to start the streak. A player attempts to stop the streak on his assigned light and achieves a score only when such action is successful. If the streak is stopped on another player's light, the other player does not receive a score.

It should be obvious to a person of skill in the art that many changes and omissions can be made in the details and arrangement of parts without departing from the scope of the invention as defined in the appended claims.

What is claimed is:

1. In a game apparatus, the combination comprising:
a series of more than two selectively energized light sources disposed for view by a player;
circuit means for controlling the energization of said light sources, said circuit means being switchable between first and second states and operative when in said first state to progressively and repetitively energize said light sources one-at-a-time to effect the appearance to the player of an illuminated light moving from one end of the series towards the other end, said light sources being energized at a rate allowing the player to operate said apparatus as a game of skill, said circuit means being operative in said second state to energize only one light source to effect the appearance of a stationary light; and,
means for switching said circuit means between said states and including player-actuated switch means operative to switch said circuit means from said first state to said second state, whereby a player upon watching the moving light can actuate said switch means and attempt to stop the moving light at a desired one of said light sources, said circuit means including means to reverse the direction in which said light sources are progressively energized, to effect the appearance to the player of an illuminated light moving back and forth.

2. The combination of claim 1 wherein said circuit means comprises:
an up/down binary counter providing output signals corresponding to individual light sources for energization thereof, said counter being automatically operative to reverse the direction of counting to thereby reverse the direction of energization.

3. The combination of claim 1 wherein:
said circuit means comprises a binary counter providing output signals corresponding to individual light sources for controlling the progression of energization;
and latch means responsive to the output of said counter for temporarily storing signals therein that keep the corresponding lights energized until said series is completely lit, to effect the appearance to the player of a lighting streak of increasing length.

4. In a game apparatus, the combination comprising:
a series of at least three selectively energized light emitting devices disposed for view by a player;
circuit means for controlling the energization of said devices, said circuit means being switchable between two states and operative in one state to repetitively energize said devices one-at-a-time in a predetermined sequence, said devices being energized at a rate allowing the player to operate said apparatus as a game of skill, said circuit means being operative in the other state to energize one of said lights;
means for switching said circuit means between said states including a first switch adapted to be actuated by a player to switch said circuit means into said one state and a second switch adapted to be actuated by a player to switch said circuit means from said one state to said other state whereby the player can exercise his skill and attempt to stop the repetitive energization of said devices at a predetermined one of said devices;
a series of scoring light emitting devices disposed for view by a player to indicate a score associated with operation of said game apparatus;
second circuit means responsive to the switching of said first-mentioned circuit means into said other state to selectively energize at least one of said scoring devices upon the occurrence of energizing a predetermined one of said first mentioned light emitting devices;
at least one additional series of scoring devices disposed for view by a player; and
third circuit means for operating said additional series whereby more than one score is observable.

5. The combination of claim 4 comprising:
a second series of scoring devices corresponding to said series of scoring light emitting devices;
first switch means adapted to be actuated by a first player for operating said series of scoring light emitting devices;
and second switch means adapted to be actuated by a second player for operating said second series.

6. In a game apparatus, the combination comprising:
a series of at least three selectively energized light emitting devices disposed for view by a player;

circuit means for controlling the energization of said devices, said circuit means being switchable between two states and operative in one state to repetitively energize said devices one-at-a-time in a predetermined sequence, said devices being energized at a rate allowing the player to operate said apparatus as a game of skill, said circuit means being operative in the other state to energize one of said lights;

means for switching said circuit means between said states including a first switch adapted to be actuated by a player to switch said circuit means into said one state and a second switch adapted to be actuated by a player to switch said circuit means from said one state to said other state whereby the player can exercise his skill and attempt to stop the repetitive energization of said devices at a predetermined one of said devices;

said circuit means comprising a binary counter, a decoder connected to said counter, an oscillator connected to said counter providing pulses thereto for stepping said counter;

said first-mentioned devices comprise light emitting diodes connected to the output of said decoder whereby one of such diodes is energized at a time which one corrresponds to the count manifested in said counter; and, additional scoring devices and additional second circuit means for operating said additional scoring devices upon stopping said moving light on different predetermined diodes.

* * * * *